US009114627B2

(12) United States Patent
Okada

(10) Patent No.: US 9,114,627 B2
(45) Date of Patent: Aug. 25, 2015

(54) DISCHARGE-PRINTING TREATMENT AGENT STORAGE CONTAINER

(75) Inventor: Goro Okada, Nagoya (JP)

(73) Assignee: BROTHER KOGYO KABUSHIKI KAISHA, Nagoya-shi (JP)

( * ) Notice: Subject to any disclaimer, the term of this patent is extended or adjusted under 35 U.S.C. 154(b) by 0 days.

(21) Appl. No.: 13/430,180

(22) Filed: Mar. 26, 2012

(65) Prior Publication Data

US 2012/0249688 A1 Oct. 4, 2012

(30) Foreign Application Priority Data

Mar. 30, 2011 (JP) ..... 2011-076276

(51) Int. Cl.
*B41J 2/21* (2006.01)

(52) U.S. Cl.
CPC ..... *B41J 2/2114* (2013.01)

(58) Field of Classification Search
USPC ..... 347/85–87
See application file for complete search history.

(56) References Cited

U.S. PATENT DOCUMENTS 4,589,000 A * 5/1986 Koto et al. ..... 347/68
4,999,652 A * 3/1991 Chan ..... 347/86
5,158,546 A * 10/1992 Haber et al. ..... 604/87
5,734,400 A * 3/1998 Brunetti et al. ..... 347/85
5,992,987 A * 11/1999 Childers et al. ..... 347/85
6,003,965 A * 12/1999 Arway et al. ..... 347/7
6,088,560 A * 7/2000 Zenk et al. ..... 399/237
6,211,400 B1 * 4/2001 Berghofer et al. ..... 560/150
6,586,622 B2 * 7/2003 Berghofer et al. ..... 562/126
7,244,812 B2 * 7/2007 Muller et al. ..... 528/480
2003/0160843 A1 * 8/2003 Hermes et al. ..... 347/84
2006/0089611 A1 * 4/2006 Herfert et al. ..... 604/367
2008/0250967 A1 10/2008 Souma et al.
2008/0309737 A1 * 12/2008 Furukawa ..... 347/85

FOREIGN PATENT DOCUMENTS

JP 2008255300 A 10/2008

* cited by examiner

*Primary Examiner* — Matthew Luu
*Assistant Examiner* — Lily Kemathe
(74) *Attorney, Agent, or Firm* — Fox Rothschild LLP

(57) ABSTRACT

A discharge-printing treatment agent storage container includes: a first treatment agent-storage container; and a second treatment agent-storage container. The first treatment agent-storage container is provided with an introduction port for introducing a second treatment agent. The introduction port is sealed with a seal member. The second treatment agent-storage container is provided with a discharge port for discharging the second treatment agent. The discharge port is linked to a discharge tube. The tip of the discharge tube is capable of being placed in the first treatment agent-storage container by releasing the introduction port from being sealed with the seal member.

3 Claims, 9 Drawing Sheets

DISCHARGE-PRINTING TREATMENT AGENT STORAGE CONTAINER

CROSS-REFERENCE TO RELATED APPLICATION

This application claims priority from Japanese Patent Application No. 2011-076276 filed on Mar. 30, 2011. The entire subject matter of the Japanese Patent Application is incorporated herein by reference.

BACKGROUND

There are cases that designs are printed on T-shirts, bathing suits, and the like by an ink-jet method in production of T-shirts, bathing suits, and the like having original designs. In the case where a ground color of a T-shirt or the like is white, a printing may be performed without a pretreatment. In contrast, in the case where the ground color is deep such as black, it is necessary that a design is printed after a discharge-printing treatment. For the discharge-printing treatment, a dedicated discharge-printing treatment agent is used. Many of discharge-printing treatment agents are two-pack type discharge-printing treatment agents each composed of two types of treatment agents. In the two-pack type discharge-printing treatment agent, one of the two types of treatment agents is a reducing treatment agent. Therefore, each of the two types of treatment agents is stored in a different container, and in use, a discharge-printing treatment agent is prepared by mixing the two-types of them.

SUMMARY

A discharge-printing treatment agent storage container is a discharge-printing treatment agent storage container for storing a discharge-printing treatment agent, the discharge-printing treatment agent storage container comprising: a first treatment agent-storage container; and a second treatment agent-storage container, wherein the discharge printing treatment agent is prepared by mixing a first treatment agent and a second treatment agent in use, the first treatment agent contains a reducing treatment agent, a part of the first treatment agent-storage container is provided with an introduction port for introducing the second treatment agent, the inside of the first treatment agent-storage container is shielded from outside air by sealing the introduction port with a seal member, the second treatment agent-storage container is provided with a discharge port for discharging the second treatment agent, the discharge port is linked to a discharge tube, a tip of the discharge tube is capable of being placed in the first treatment agent-storage container by releasing the introduction port from being sealed with the seal member, and the second treatment agent is capable of being transferred from the second treatment agent-storage container to the first treatment agent-storage container by pressure under a state where the tip of the discharge tube is placed in the first treatment agent-storage container.

DETAILED DESCRIPTION

Figure 1:
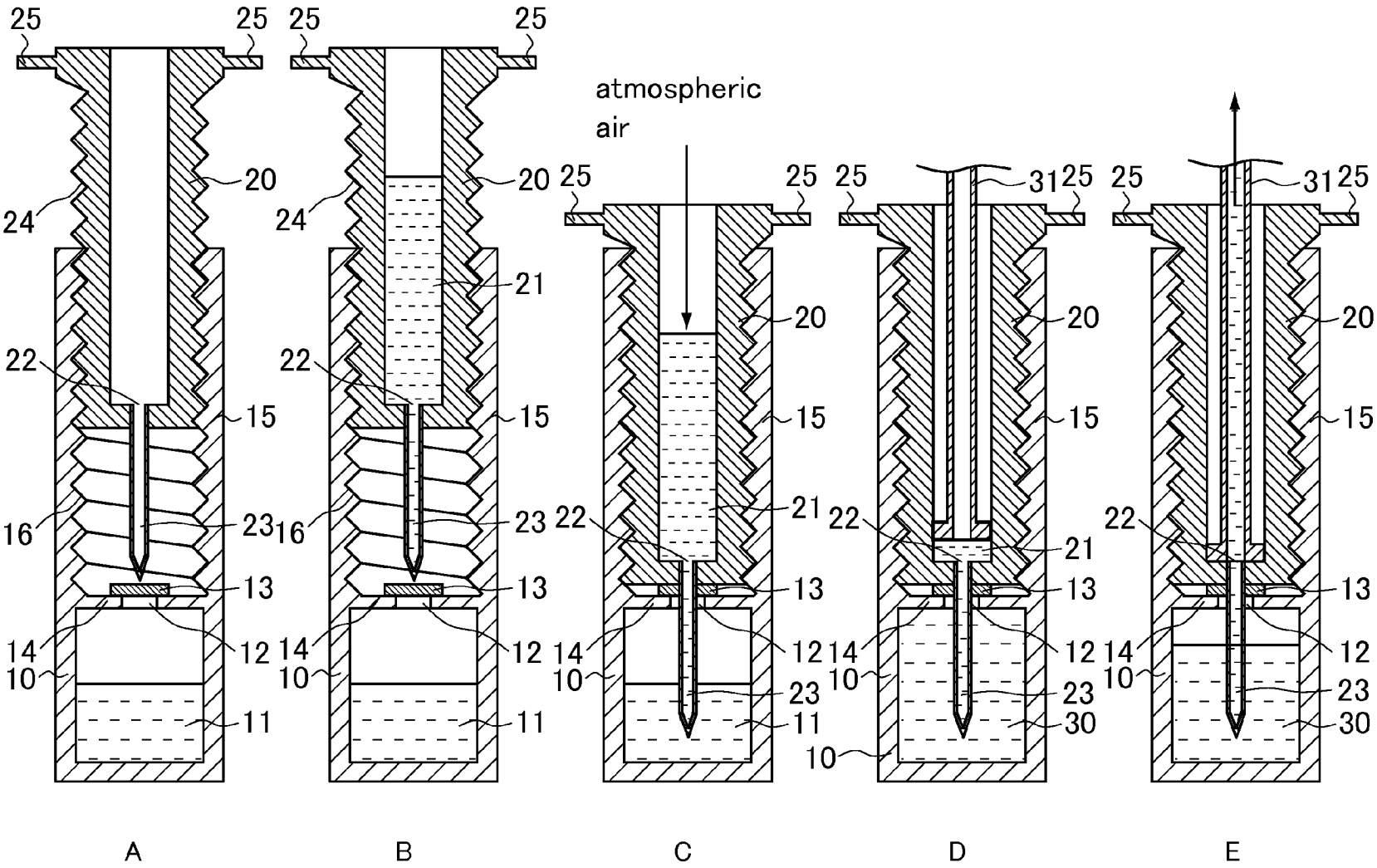
FIGS. 1A to 1E are cross-sectional views showing an example of the configuration of a discharge-printing treatment agent storage container of the first embodiment.

In a discharge-printing treatment agent storage container of the first embodiment, the inside of the first treatment agent-storage container is under negative pressure, a part of the second treatment agent-storage container is opened to the outside, and the second treatment agent is capable of being transferred utilizing the negative pressure.

The discharge-printing treatment agent storage container of the first embodiment, further comprising: a downward movement unit of causing the second treatment agent-storage container to move downward, the second treatment agent-storage container is placed on the first treatment agent-storage container with a certain distance, a ceiling part of the first treatment agent-storage container is provided with the introduction port, the introduction port is sealed with the sealing member, an upper part of the second treatment agent-storage container is opened, a bottom part of the second treatment agent-storage container is provided with the discharge port, the discharge tube linked to the discharge port is a needle, and a tip of the needle is capable of being placed in the first treatment agent-storage container by causing the needle to penetrate the seal member through causing the second treatment agent-storage container to move downward by the downward movement unit.

In a discharge-printing treatment agent storage container of the second embodiment, the inside of the first treatment agent-storage container is under an atmosphere of inactive gas, and the second treatment agent is capable of being transferred while discharging the inactive gas from the first treatment agent-storage container by applying pressure to the inside of the second treatment agent-storage container.

In the discharge-printing treatment agent storage container of the second embodiment, the seal member sealing the introduction port of the first treatment agent-storage container is a first check valve, a part of the first treatment agent-storage container is provided with an exhaust port for exhausting the inactive gas, the exhaust port is sealed with a second check valve, the second treatment agent-storage container is a cylinder capable of inserting a piston therein, a side opposite to a side of inserting the piston of the cylinder is provided with the discharge port, the discharge tube is linked to the discharge port, a tip of the discharge tube is capable of being placed in the first treatment agent-storage container by opening the first check valve through inserting the discharge tube to the introduction port, the second treatment agent in the cylinder is capable of being transferred by applying pressure with the piston under a state where the tip of the discharge tube is placed in the first treatment agent-storage container, and the inactive gas is capable of being exhausted from the exhaust port by opening the second check valve according to the transfer of the second treatment agent.

In a discharge-printing treatment agent storage container of the third embodiment, a volume of the first treatment agent-storage container is capable of being expanded by moving a part thereof, and the second treatment agent is capable of being transferred while expanding the volume of the first treatment agent-storage container by applying pressure to the inside of the second treatment agent-storage container.

In the discharge-printing treatment agent storage container of the third embodiment, the seal member sealing the introduction port of the first treatment agent-storage container is a first check valve, the first treatment agent-storage container has a double bottom structure including an inner bottom and an outer bottom, the inner bottom in the double bottom structure is movable toward outside, a part of the outer bottom in the double bottom structure is provided with an opening, the second treatment agent-storage container is a cylinder capable of inserting a piston therein, a side opposite to a side of inserting the piston of the cylinder is provided with the discharge port, the discharge tube is linked to the discharge port, the tip of the discharge tube is capable of being placed in the first treatment agent-storage container by opening the first check valve through inserting the discharge tube to the introduction port, the second treatment agent in the cylinder is capable of being transferred by applying pressure with the piston under a state where the tip of the discharge tube is placed in the first treatment agent-storage container, and atmospheric air is capable of being exhausted from the opening of the outer bottom according to a movement of the inner bottom by the transfer of the second treatment agent.

In the discharge-printing treatment agent storage container of the third embodiment, a part of the first treatment agent-storage container is composed of a deformable member as substitute for the inner bottom that is movable of the double bottom structure, the second treatment agent in the cylinder is capable of being transferred by applying pressure with the piston under a state where the tip of the discharge tube is placed in the first treatment agent-storage container, and atmospheric air is capable of being exhausted from the opening of the outer bottom according to a deformation of the part of the first treatment agent-storage container by the transfer of the second treatment agent.

A discharge-printing treatment agent storage container of the fourth embodiment, further comprising: a first treatment agent-supply container, the first treatment agent-supply container is provided with a discharge port for discharging the first treatment agent, the discharge port is linked to a discharge tube, the first treatment agent-storage container is provided with a first introduction port for introducing the first treatment agent and a second introduction port for introducing the second treatment agent, the first introduction port is sealed with a first check valve, the second introduction port is sealed with a second check valve, a tip of the discharge tube on the first treatment agent-supply container is capable of being placed in the first treatment agent-storage container by opening the first check valve through inserting the discharge tube on the first treatment agent-supply container to the first introduction port, the first treatment agent is capable of being transferred from the first treatment agent-supply container to the first treatment agent-storage container by applying pressure under a state where the tip of the discharge tube on the first treatment agent-supply container is placed in the first treatment agent-storage container, a tip of the discharge tube on the second treatment agent-storage container is capable of being placed in the first treatment agent-storage container by opening the second check valve through inserting the discharge tube on the second treatment agent-storage container to the second introduction port, and the second treatment agent is capable of being transferred from the second treatment agent-storage container to the first treatment agent-storage container by pressure under a state where the tip of the discharge tube on the second treatment agent-storage container is placed in the first treatment agent-storage container.

The discharge-printing treatment agent is prepared by mixing a first treatment agent and a second treatment agent in use. The first treatment agent contains a reducing treatment agent that is deteriorated by oxygen. Examples of the reducing treatment agent include: sulfinic acid-based reducing agents such as zinc formaldehyde sulfoxylate and sodium formaldehyde sulfoxylate; tin-based reducing agents such as stannous chloride, stannic chloride, stannous benzoate, stannous trimellitate, and stannous silicate; salts of hydrosulfite (for example, a sodium salt, an aluminum salt, and a calcium salt); a bleaching powder; sodium hypochlorite; and sodium chlorate. The first treatment agent may further contain a component besides the reducing treatment agent. The component besides the reducing treatment agent may be, for example, water. The first treatment agent is a liquid or a solid. On the other hand, the second treatment agent does not contain a component that is deteriorated by oxygen. Therefore, there is no problem even when the second treatment agent is in contact with oxygen before being mixed with the first treatment agent. A component of the second treatment agent may be, for example, water. The second treatment agent is a liquid.

The embodiments as examples of the present invention are described below with reference to the views. Note here that the present invention is not restricted or limited by the following embodiments.

First Embodiment

The present embodiment is an embodiment in which a second treatment agent is transferred from the second treatment agent-storage container to the first treatment agent-storage container utilizing the negative pressure in the first treatment agent-storage container.

An example of the configuration of the discharge-printing treatment agent storage container of the present embodiment is shown in cross-sectional views of FIGS. 1A to 1E. As shown in FIGS. 1A to 1E, the discharge-printing treatment agent storage container of the present example comprises a first treatment agent-storage container 10 and a second treatment agent-storage container 20. The first treatment agent-storage container 10 is cylindrical, and a ceiling part 14 thereof is provided with an introduction port 12 for introducing a second treatment agent 21. The introduction port 12 is sealed with a seal member 13, so that the inside of the first treatment agent-storage container 10 is shielded from outside air and is under negative pressure. In order to make the inside of the first treatment agent-storage container 10 under negative pressure, gas in the first treatment agent-storage container 10 is exhausted by being vacuumed by a vacuum pump, for example, or an agent for absorbing oxygen is placed in the first treatment agent-storage container 10. A first treatment agent 11 is stored in the first treatment agent-storage container 10. A side wall 15 of the first treatment agent-storage container 10 is extended upward from the ceiling part 14, and the inner side of the side wall 15 is provided with thread grooves 16. The second treatment agent-storage container 20 is approximately cylindrical, the upper part thereof is opened, and the outer side of a side wall of the second treatment agent-strange container 20 is provided with screw threads 24 corresponding to the thread grooves 16. An upper part on the outer side of the side wall of the second treatment agent-storage container 20 is provided with a handle 25 capable of rotating the second treatment agent-storage container 20. A bottom part of the second treatment agent-storage container 20 is provided with a discharge port 22 for discharging a second treatment agent 21. The discharge port 22 is linked to a discharge tube (a needle in the present embodiment) 23.

A method for using the discharge-printing treatment agent storage container of the present example is described below. First, as shown in FIG. 1A, a second treatment agent-storage container 20 is placed on a first treatment agent-storage container 10 with a certain distance. Specifically, the second treatment agent-storage container 20 is screwed into a side wall 15 using a handle 25 until a needle 23 reaches in front of a seal member 13. In the discharge-printing treatment agent storage container of the present example, a mark indicating how far the second treatment agent-storage container 20 should be screwed into is provided on the outer side of the side wall 15 of second treatment agent-storage container 20.

Then, as shown in FIG. 1B, a second treatment agent 21 is filled in the second treatment agent-storage container 20.

Thereafter, as shown in FIG. 1C, the second treatment agent-storage container 20 is screwed into the side wall 15 using the handle 25 until the bottom surface thereof is in contact with the seal member 13. Thus, the needle 23 penetrates the seal member 13, and the tip of the needle 23 is placed in the first treatment agent-storage container 10. In this case, the inside of the first treatment agent-storage container 10 is under negative pressure, so that the second treatment agent 21 is transferred from the second treatment agent-storage container 20 to the first treatment agent-storage container 10 by atmospheric pressure. In this case, as shown in FIG. 1D, a small amount of the second treatment agent 21 remains in the second treatment agent-storage container 20, so that a discharge-printing treatment agent 30 prepared by mixing a first treatment agent 11 and the second treatment agent 21 is shielded from outside air.

After completion of the transfer of the second treatment agent 21, as shown in FIG. 1D, a cylindrical transport tube 31 for a discharge-printing treatment agent, the bottom part of which has been opened, is inserted into the second treatment agent-storage container 20.

After discharging the small amount of the second treatment agent 21 remaining in the second treatment agent storage container 20, as shown in FIG. 1E, the opening of the bottom part of the transport tube 31 is brought into contact with the discharge port 22. Thereafter, the discharge-printing treatment agent 30 is transported to the outside using the transport tube 31.

In the present example, the discharge-printing of fabric such as a T-shirt may be performed by applying the discharge-printing treatment agent 30 by an ink-jet method, a spraying method, a stamping method, a brushing method, or a rolling method. With respect to the discharge-printing of fabric, the same may apply to the other examples of the present embodiment and the other embodiments.

Another example of the configuration of the discharge-printing treatment agent storage container of the present embodiment is shown in cross-sectional views of FIGS. 2A to 2D. In FIGS. 2A to 2D, the identical parts to those in FIGS. 1A to 1E are indicated by identical reference numerals. As shown in FIGS. 2A to 2D, the configuration of the discharge-printing treatment agent storage container of the present example is the same as that shown in FIGS. 1A to 1E except that a second treatment agent 21 is previously filled in a second treatment agent-storage container 20, and an upper opening of the second treatment agent-storage container 20 is sealed with a seal member 26.

A method for using the discharge-printing treatment agent storage container of the present example is described below. First, as shown in FIG. 2A, a second treatment agent-storage container 20 is placed on a first treatment agent-storage container 10 so that a needle 23 is in front of a seal member 13.

Figure 2:
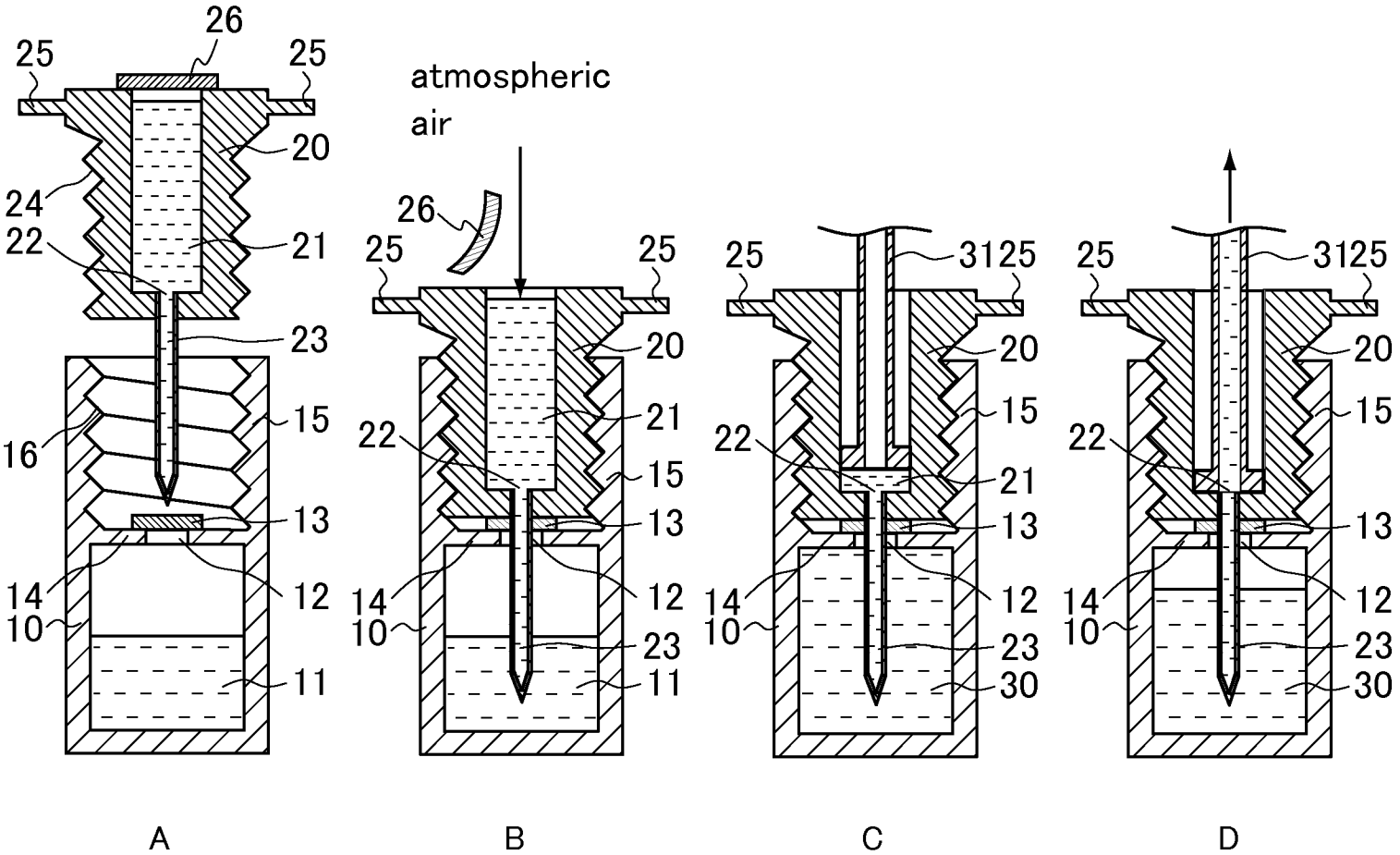
FIGS. 2A to 2D are cross-sectional views showing another example of the configuration of the discharge-printing treatment agent storage container of the first embodiment.

Then, as shown in FIG. 2B, the second treatment agent-storage container 20 is screwed into a side wall 15 using a handle 25 until the bottom surface thereof is in contact with the seal member 13. Thus, the needle 23 penetrates the seal member 13, and the tip of the needle 23 is placed in the first treatment agent-storage container 10. Thereafter, a seal member 26 with which an upper opening of the second treatment agent-storage container 20 has been sealed is removed. In this case, the inside of the first treatment agent-storage container 10 is under negative pressure. Therefore, a second treatment agent 21 is transferred from the second treatment agent-storage container 20 to the first treatment agent-storage container 10.

Subsequently, as shown in FIGS. 2C and 2D, the same operations as shown in FIGS. 1D and 1E are performed.

Yet another example of the configuration of the discharge-printing treatment agent storage container of the present embodiment is shown in cross-sectional views of FIGS. 3A to 3E. In FIGS. 3A to 3E, identical parts to those in FIGS. 1A to 1E are indicated by the identical reference numerals. The present example is an example in which a second treatment agent is transferred from a second treatment agent-storage container to a first treatment agent-storage container by applying pressure with a transport tube besides negative pressure in the first treatment agent-storage container. As shown in FIGS. 3A to 3E, in the discharge-printing treatment agent storage container of the present example, a diameter of an upper opening of a second treatment agent-storage container 20 is increased at its upper end part in order for a transport tube 31 to be easily inserted therein. Moreover, the discharge-printing treatment agent storage container of the present example is provided with a receiving groove 27 for receiving an overflow of a second treatment agent 21 from the upper end part of the upper opening of the second treatment agent-storage container 20 when the transport tube 31 is inserted.

A method for using the discharge-printing treatment agent storage container of the present example is described below. First, as shown in FIG. 3A, a second treatment agent-storage container 20 is screwed into a side wall 15 using a handle 25 until a needle 23 reaches in front of a seal member 13 in the same manner as in FIG. 1A.

Figure 3:
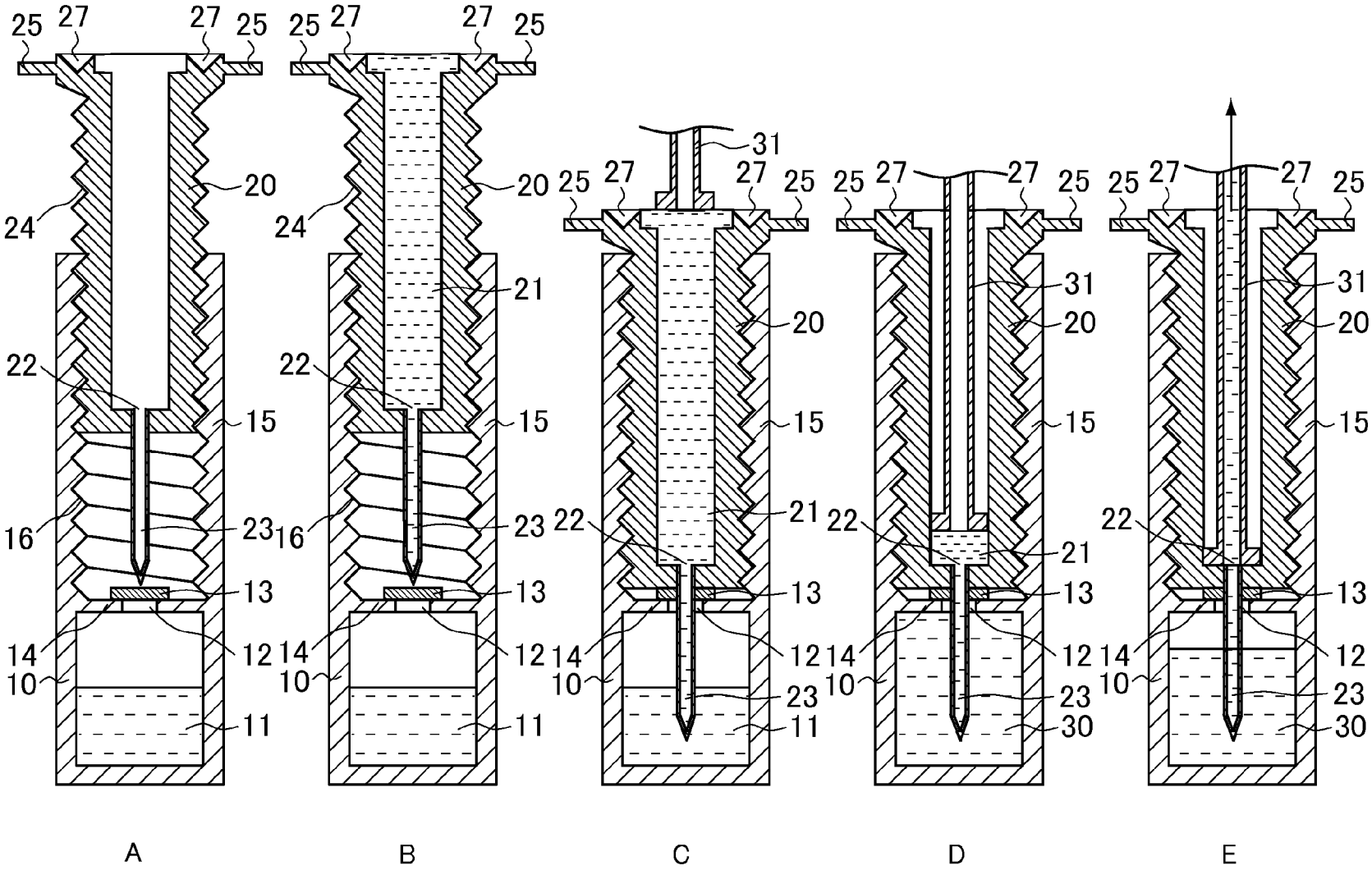
FIGS. 3A to 3E are cross-sectional views showing yet another example of the configuration of the discharge-printing treatment agent storage container of the first embodiment.

Then, as shown in FIG. 3B, a second treatment agent 21 is filled in the second treatment agent-storage container 20 up to the upper end part of the upper opening.

Thereafter, as shown in FIG. 3C, the second treatment agent storage container 20 is screwed into the side wall 15 using the handle 25 until the bottom surface thereof is in contact with the seal member 13, so that the needle 23 penetrates the seal member 13, and the tip of the needle 23 is placed in the first treatment agent-storage container 10. Subsequently, a transport tube 31 is placed so as to be in contact with the upper surface of the second treatment agent 21.

Then, as shown in FIG. 3D, the second treatment agent 21 is transferred from the second treatment agent-storage container 20 to the first treatment agent-storage container 10 by applying pressure with the transport tube 31 besides negative pressure in the first treatment agent-storage container 10. According to the present example, the second treatment agent 21 may be transferred in a short time. Moreover, an overflow of the second treatment agent 21 from an upper end part of an upper opening of the second treatment agent-storage container 20 is received by a receiving groove 27, so that there is no case that a surrounding area of the discharge-printing treatment agent storage container gets dirty with the second treatment agent 21.

Subsequently, as shown in FIG. 3E, the same operation as shown in FIG. 1E is performed.

Second Embodiment

The present embodiment is an embodiment in which a second treatment agent is transferred from a syringe that is a second treatment agent-storage container to a first treatment agent-storage container with a piston.

An example of the configuration of the discharge-printing treatment agent storage container of the present embodiment is shown in cross-sectional views of FIGS. 4A to 4E. As shown in FIGS. 4A to 4E, the discharge-printing treatment agent storage container of the present example comprises a first treatment agent-storage container 40 and a cylinder (second treatment agent-storage container) 50 capable of inserting a piston 54 therein. The first treatment agent-storage container 40 has a tubular shape such as a cylindrical shape or a rectangular-tube like shape. A ceiling part 44 of the first treatment agent-storage container 40 is provided with an introduction port 42 for introducing a second treatment agent 51. The introduction port 42 is sealed with a first check valve 43, so that the inside of the first treatment agent-storage container 40 is shielded from outside air and is under an atmosphere of inactive gas. Examples of the inactive gas include nitrogen and argon. An upper part of a side wall of the first treatment agent-storage container 40 is provided with an exhaust port 45 for exhausting the inactive gas. The exhaust port 45 is sealed with a second check valve 46. A first treatment agent 41 is stored in the first treatment agent-storage container 40. The cylinder 50 has a tubular shape such as a cylindrical shape or a rectangular-tube like shape. The side opposite to the side of inserting the piston 54 (upper side in FIGS. 4A to 4E) of the cylinder 50 is provided with a discharge port 52. The discharge port 52 is linked to a discharge tube 53.

A method for using the discharge-printing treatment agent storage container of the present example is described below. First, as shown in FIG. 4A, a second treatment agent 51 is drawn into a syringe 50.

Figure 4:
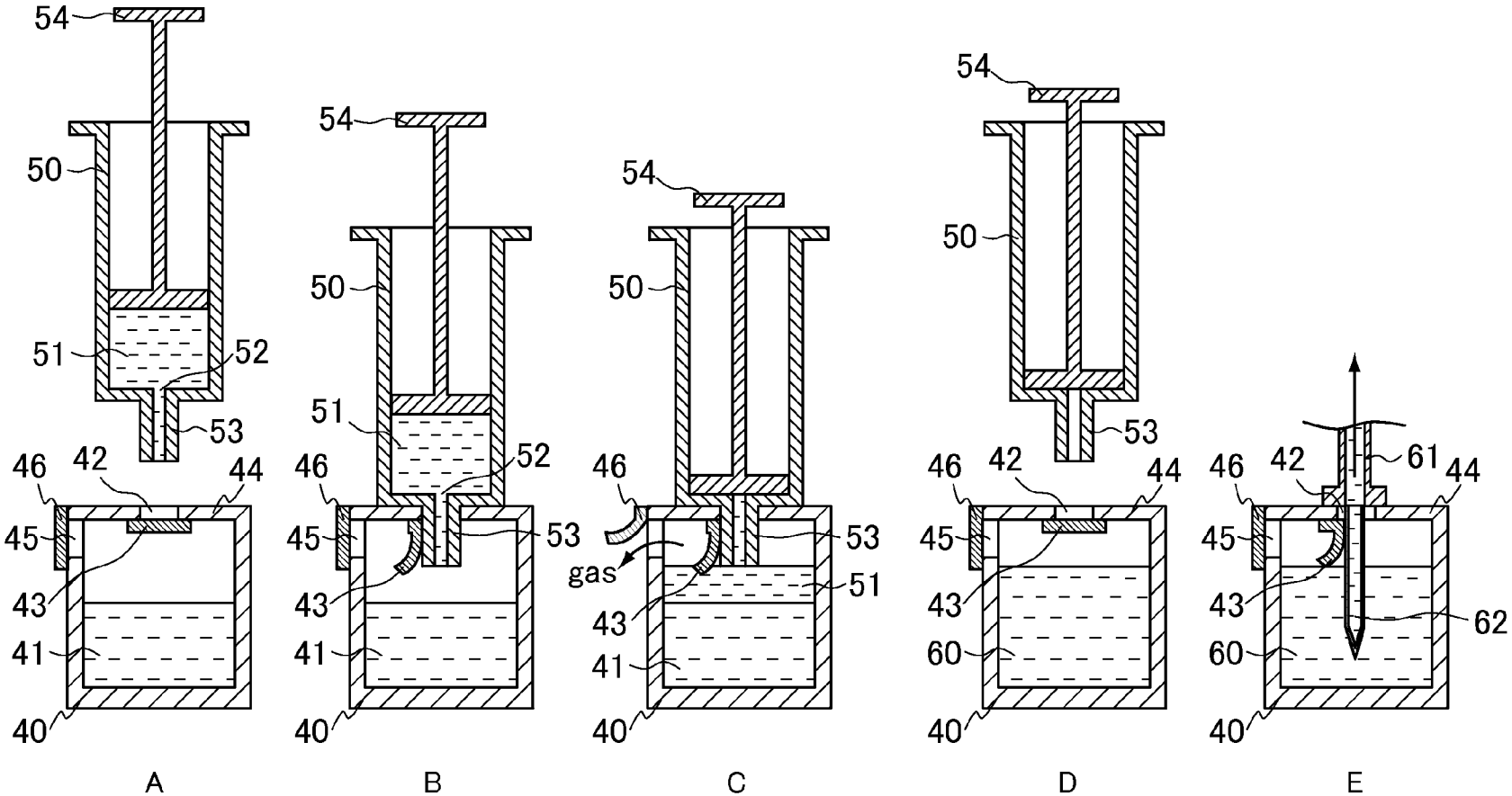
FIGS. 4A to 4E are cross-sectional views showing an example of the configuration of a discharge-printing treatment agent storage container of the second embodiment.

Then, as shown in FIG. 4B, the tip of a discharge tube 53 is placed in a first treatment agent-storage container 40 by opening a first check valve 43 through inserting a discharge tube 53 into an introduction port 42.

Thereafter, as shown in FIG. 4C, the second treatment agent 51 in the cylinder 50 is transferred to the first treatment agent-storage container 40 by applying pressure to the second treatment agent 51 with a piston 54 under the state where the tip of the discharge tube 53 is placed in the first treatment agent-storage container 40. In this case, inactive gas is exhausted from an exhaust port 45 by opening a second check valve 46 according to the transfer of the second treatment agent 51.

Then, as shown in FIG. 4D, by pulling the tip of the discharge tube 53 out of the introduction port 42, the introduction port 42 is sealed with the first check valve 43, and the exhaust port 45 is sealed with the second check valve 46. Therefore, a discharge-printing treatment agent 60 prepared by mixing a first treatment agent 41 and the second treatment agent 51 is shielded from outside air.

Subsequently, as shown in FIG. 4E, a transport needle 62 that is placed at the tip of a transport tube 61 is inserted into the introduction port 42, so that the first check valve 43 is opened. Then, under this state, the discharge-printing treatment agent 60 is transported to the outside.

Another example of the configuration of the discharge-printing treatment agent storage container of the present embodiment is shown in cross-sectional views of FIGS. 5A to 5E. In FIGS. 5A to 5E, identical parts to those in FIGS. 4A to 4E are indicated by the identical reference numerals. The present example is an example in which a first treatment agent-storage container is provided with an introduction path for a discharge tube. As shown in FIGS. 5A to 5E, the discharge-printing treatment agent storage container of the present example comprises a first treatment agent-storage container 40 and a cylinder (second treatment agent-storage container) 50 capable of inserting a piston 54 therein. The first treatment agent-storage container 40 has a tubular shape such as a cylindrical shape or a rectangular-tube like shape. A bottom part 47 of the first treatment agent-storage container 40 is provided with an introduction port 42 for introducing a second treatment agent 51. The first treatment agent-storage container 40 is provided with a first treatment agent storage part 48. The side part of the first treatment agent storage part 48 is provided with an introduction path 49 extended from the introduction port 42 toward the inside of the first treatment agent-storage container 40. The boundary between the first treatment agent storage part 48 and the introduction path 49 is sealed with a first check valve 43, so that the inside of the first treatment agent-storage container 40 is shielded from outside air and is under an atmosphere of inactive gas. The inactive gas is the same as mentioned above. A ceiling part of the first treatment agent-storage container 40 is provided with an exhaust port 45 for exhausting the inactive gas. The exhaust port 45 is sealed with a second check valve 46. A first treatment agent 41 is stored in the first treatment agent storage part 48. The configuration of the cylinder 50 is the same as that in the discharge-printing treatment agent storage container shown in FIGS. 4A to 4E.

A method for using the discharge-printing treatment agent storage container of the present example is described below. First, as shown in FIG. 5A, a second treatment agent 51 is drawn into a cylinder 50.

Figure 5:
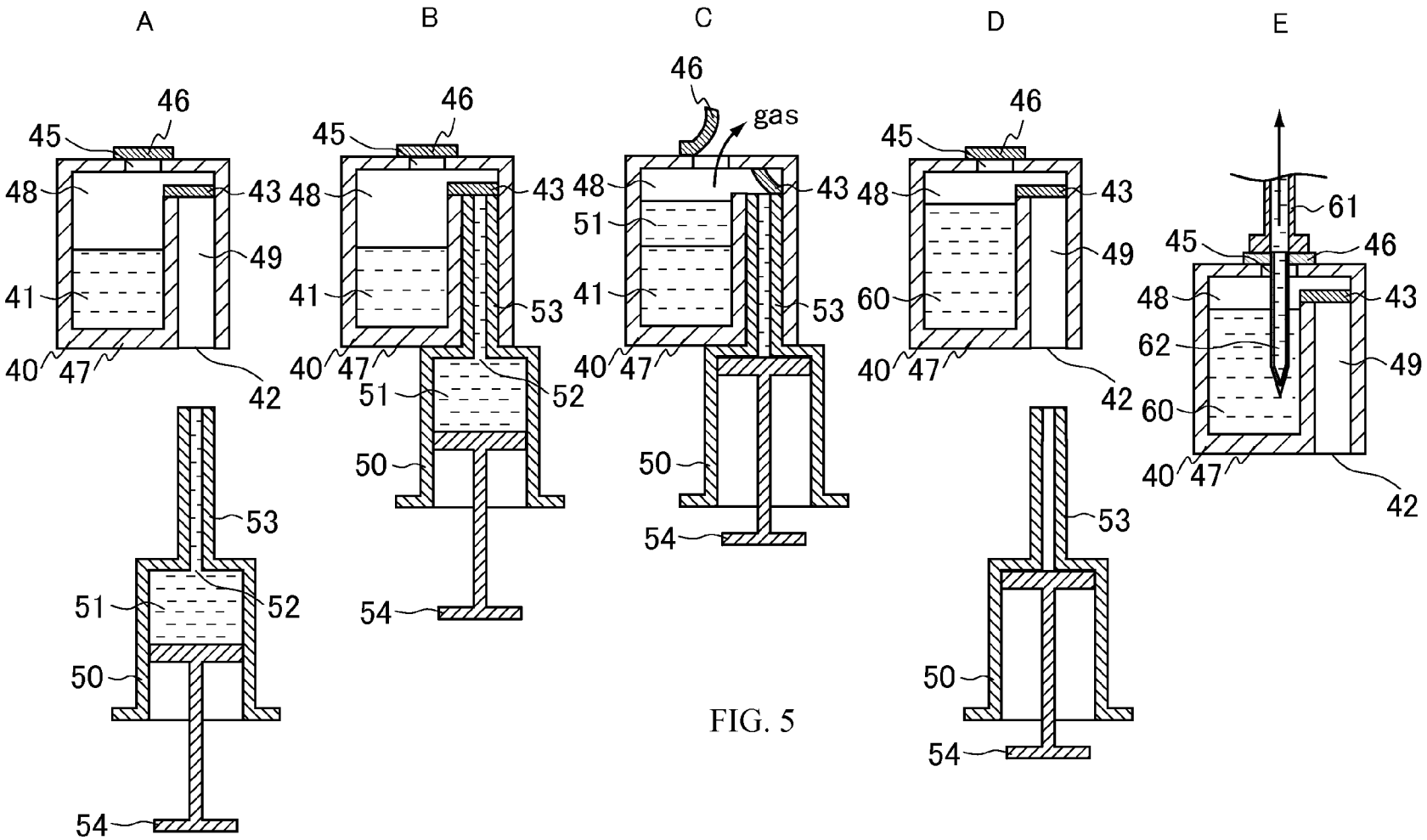
FIGS. 5A to 5E are cross-sectional views showing another example of the configuration of the discharge-printing treatment agent storage container of the second embodiment.

Then, as shown in FIG. 5B, the tip of a discharge tube 53 is placed in front of a first check valve 43 by inserting the tip of the discharge tube 53 from an introduction port 42 to an introduction path 49.

Thereafter, as shown in FIG. 5C, the second treatment agent 51 is transferred to a first treatment agent-storage container 10 by opening the first check valve 43 through applying pressure to the second treatment agent 51 that is in the cylinder 50 with a piston 54 under the state where the tip of the discharge tube 53 is placed in front of the first check valve 43. In this case, inactive gas is exhausted from an exhaust port 45 by opening a second check valve 46 according to the transfer of the second treatment agent 51.

Subsequently, as shown in FIG. 5D, by pulling the tip of the discharge tube 53 out of the introduction path 49 and the introduction port 42, the boundary between a first treatment agent storage part 48 and the introduction path 49 is sealed with the first check valve 43, and the exhaust port 45 is sealed with the second check valve 46. Therefore, a discharge-printing treatment agent 60 prepared by mixing a first treatment agent 41 and the second treatment agent 51 is shielded from outside air.

Then, as shown in FIG. 5E, a transport needle 62 that is placed at the tip of a transport tube 61 is caused to penetrate the second check valve 46, so that the tip of the transport needle 62 is inserted into the first treatment agent storage part 48. Thereafter, the discharge-printing treatment agent 60 is transported to the outside.

Third Embodiment

The present embodiment is an embodiment in which a second treatment agent is transferred while expanding a volume of a first treatment agent-storage container by causing a part thereof to move by applying pressure to the inside of a second treatment agent-storage container.

An example of the configuration of the discharge-printing treatment agent storage container of the present embodiment is shown in cross-sectional views of FIGS. 6A to 6E. In FIGS. 6A to 6E, identical parts to those in FIGS. 4A to 4E are indicated by the identical reference numerals. As shown in FIGS. 6A to 6E, the discharge-printing treatment agent storage container of the present example comprises a first treatment agent-storage container 40 and a cylinder (second treatment agent-storage container) 50 capable of inserting a piston 54 therein. The first treatment agent-storage container 40 has a tubular shape such as a cylindrical shape or a rectangular-tube like shape. A ceiling part 44 of the first treatment agent-storage container 40 is provided with an introduction port 42 for introducing a second treatment agent 51. The introduction port 42 is sealed with a first check valve 43. The first treatment agent-storage container 40 is filled with a first treatment agent 41 and is shielded from outside air. The first treatment agent-storage container 40 has a double bottom structure including an inner bottom 71 and an outer bottom 72. In the double bottom structure, the inner bottom 71 is movable toward the outside, and the outer bottom 72 is provided with an opening 73. The configuration of the cylinder 50 is the same as that in the discharge-printing treatment agent storage container shown in FIGS. 4A to 4E except that the cylinder 50 includes a plan stopper 55 that has a plan shape shown in FIG. 7 at the end part of the piston 54. In the discharge-printing treatment agent storage container of the present example, the state where the second treatment agent 51 is stored in the syringe 50 is maintained for a long period of time by fixing the end part of the piston 54 with the stopper 55.

A method for using the discharge-printing treatment agent storage container of the present example is described below. First, a second treatment agent 51 is drawn into a cylinder 50. Then, as shown in FIG. 6A, the end part of a piston 54 is fixed with a stopper 55, so that the state where the second treatment agent 51 is stored in the cylinder 50 is maintained.

Figure 6:
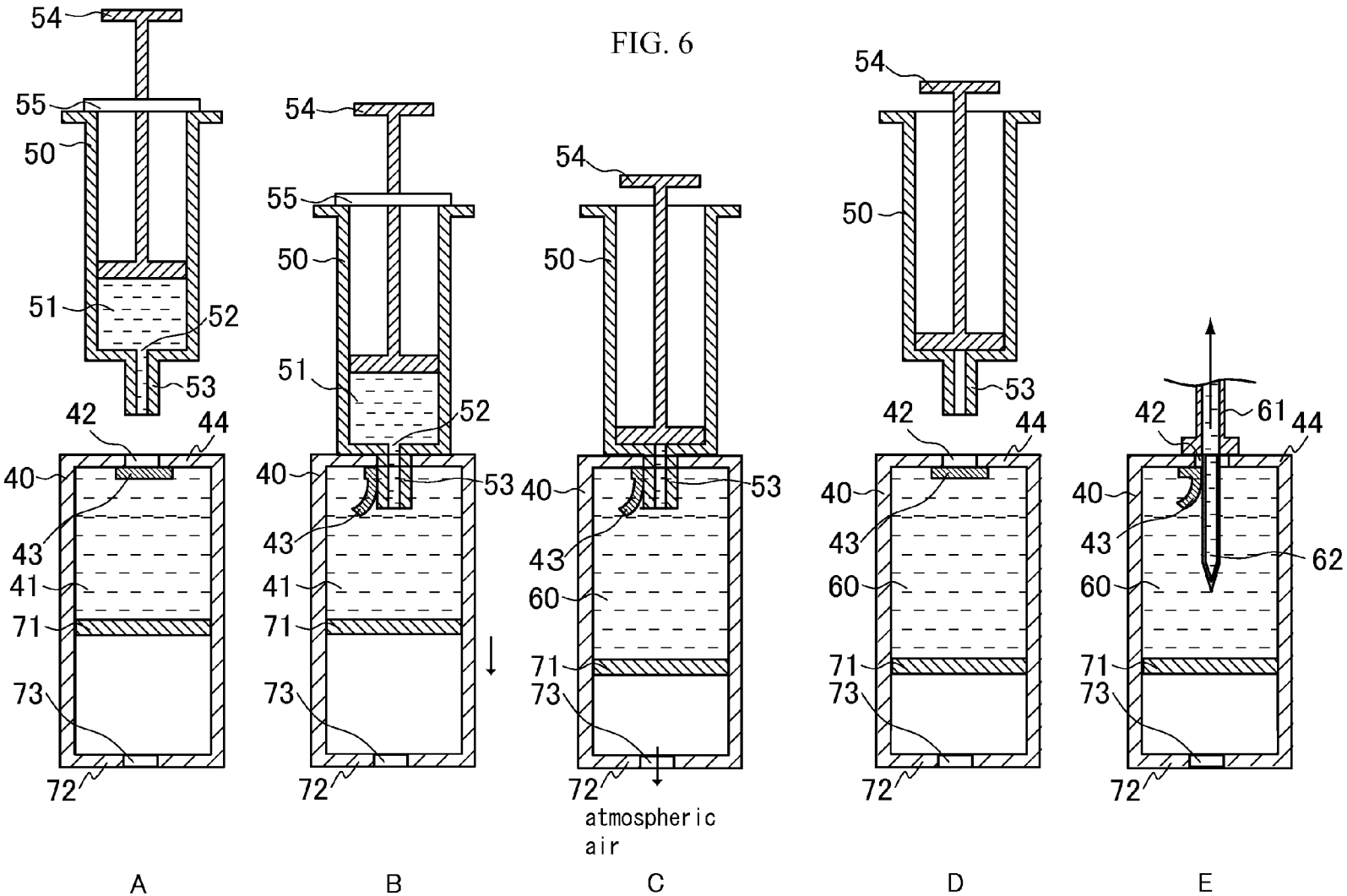
FIGS. 6A to 6E are cross-sectional views showing an example of the configuration of a discharge-printing treatment agent storage container of the third embodiment.
Figure 7:
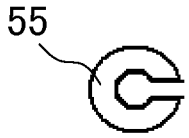
FIG. 7 is a plan view showing an example of a stopper in the discharge-printing treatment agent storage container of the third embodiment.
Figure 8:
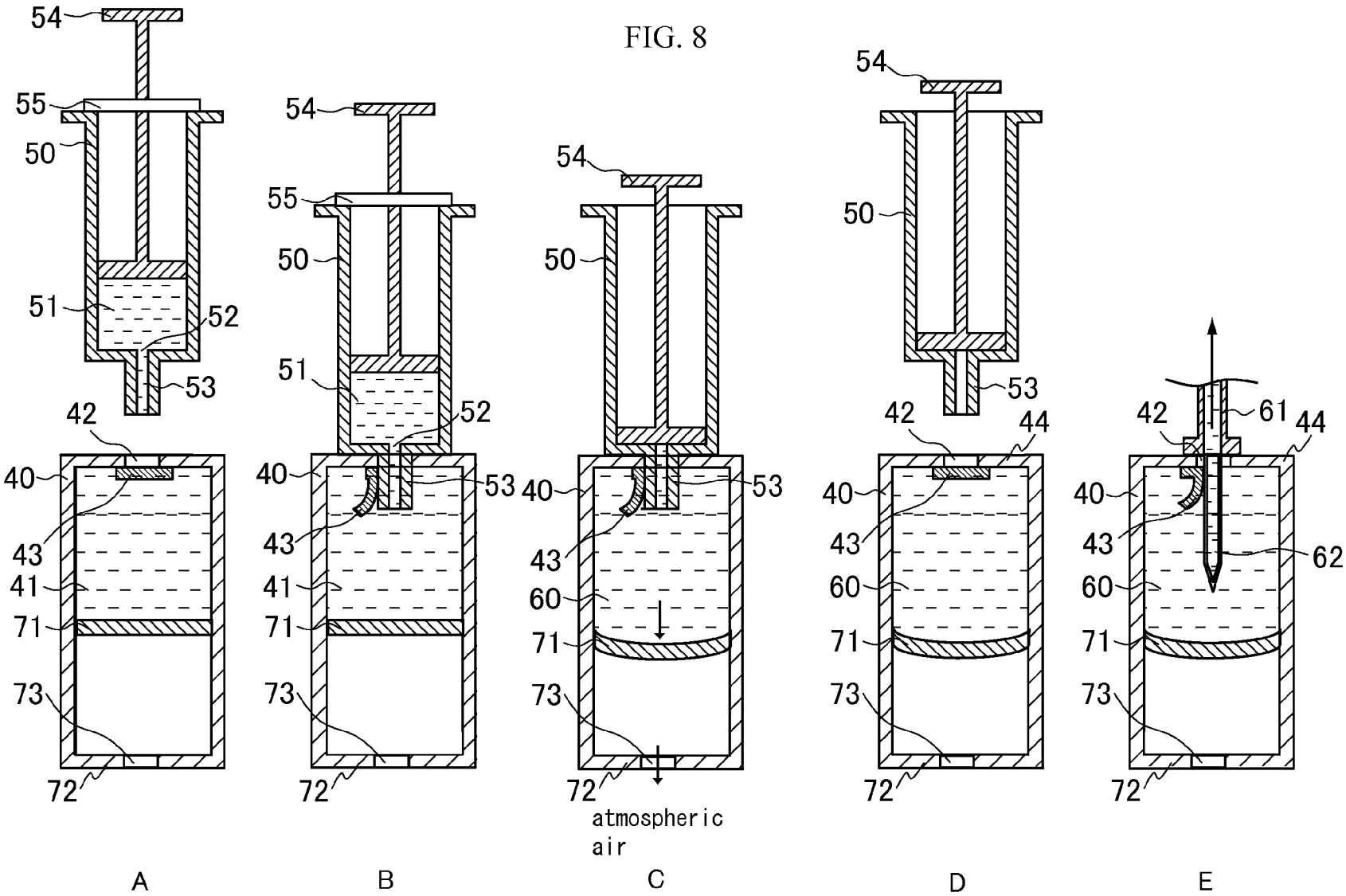
FIGS. 8A to 8E are cross-sectional views showing another example of the configuration of the discharge-printing treatment agent storage container of the third embodiment.

Thereafter, as shown in FIG. 6B, the tip of a discharge tube 53 is placed in a first treatment agent-storage container 40 by opening a first check valve 43 through inserting the discharge tube 53 into an introduction port 42.

After removing the stopper 55 fixing the end part of the piston 54, as shown in FIG. 6C, the second treatment agent 51 in the cylinder 50 is transferred to the first treatment agent-storage container 40 by applying pressure to the second treatment agent 51 with the piston 54 under the state where the tip of the discharge tube 53 is placed in the first treatment agent-storage container 40. In this case, air is discharged from an opening 73 of an outer bottom 72 according to the movement of an inner bottom 71 caused by the transfer of the second treatment agent 51.

Subsequently, as shown in FIGS. 6D and 6E, the same operations as shown in FIGS. 4D and 4E are performed.

Another example of the configuration of the discharge-printing treatment agent storage container of the present embodiment is shown in cross-sectional views of FIGS. 8A to 8E. In FIGS. 8A to 8E, identical parts to those in FIGS. 6A to 6E are indicated by the identical reference numerals. As shown in FIGS. 8A to 8E, the configuration of the discharge-printing treatment agent storage container of the present example is the same as that shown in FIGS. 6A to 6E except that an inner bottom 71 is the one formed of a deformable member as substitute for the one that is movable. As described above, a second treatment agent 51 may be transferred by deforming the deformable member (for example, a polypropylene sheet, a polyethylene sheet, or a silicone resin sheet) through applying pressure.

The discharge-printing treatment agent storage container of the second embodiment may comprise a stopper 55 as in the present embodiment.

Fourth Embodiment

The present embodiment is an embodiment further comprising a first treatment agent-supply container.

Figure 9:
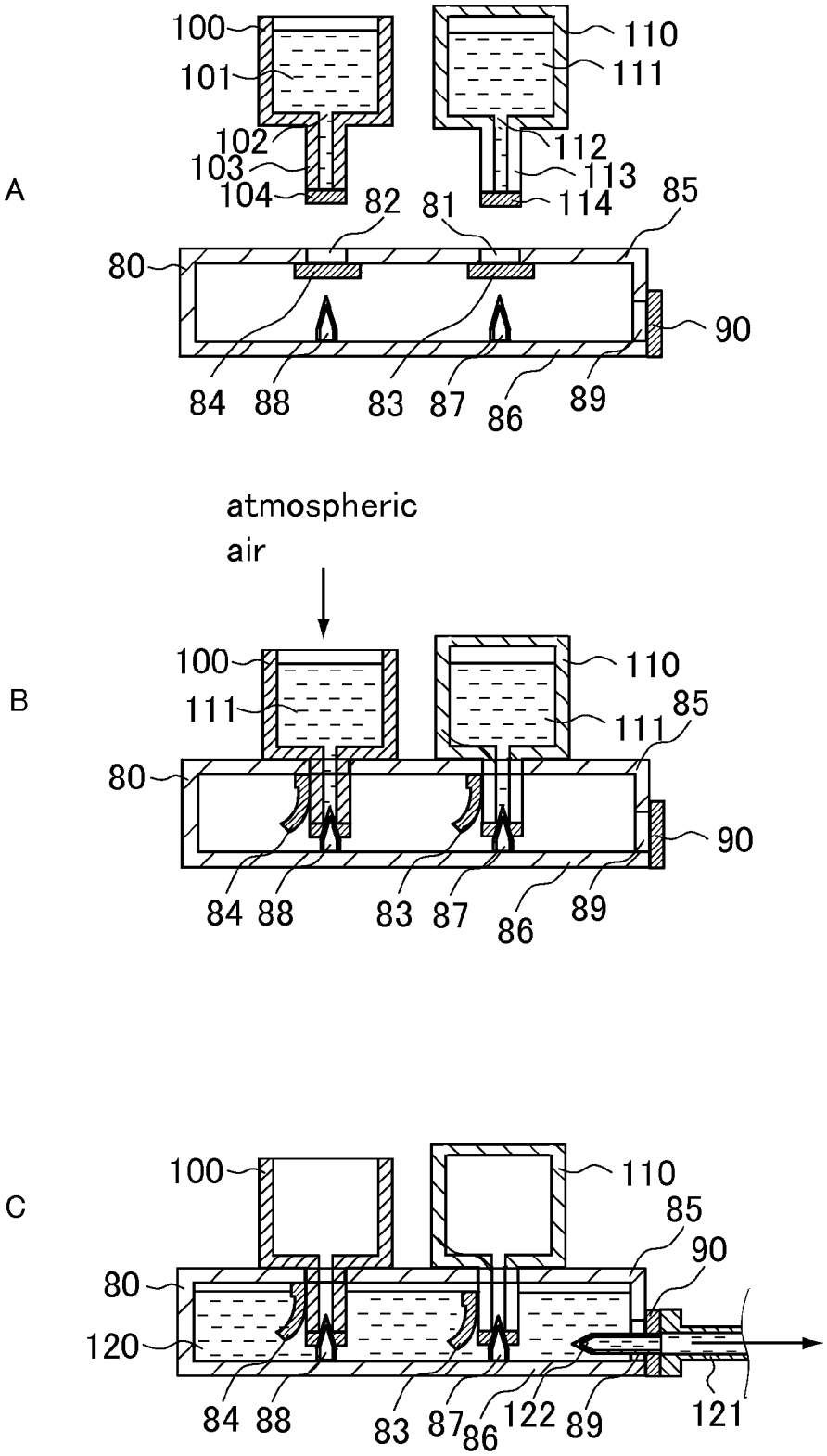
FIGS. 9A to 9C are cross-sectional views showing an example of the configuration of a discharge-printing treatment agent storage container of the fourth embodiment.

The configuration of the discharge-printing treatment agent storage container of the present embodiment is shown in cross-sectional views of FIGS. 9A to 9C. As shown in FIGS. 9A to 9C, the discharge-printing treatment agent storage container of the present embodiment comprises a first treatment agent-storage container 80, a second treatment agent-storage container 100, and a first treatment agent-supply container 110. The first treatment agent-storage container 80 has a tubular shape such as a cylindrical shape or a rectangular-tube like shape. A ceiling part 85 of the first treatment agent-storage container 80 is provided with a first introduction port 81 for introducing a first treatment agent 111 and a second introduction port 82 for introducing a second treatment agent 101. The first introduction port 81 is sealed with a first check valve 83, and the second introduction port 82 is sealed with a second check valve 84, so that the inside of the first treatment agent-storage container 80 is shielded from outside air and is under negative pressure. A method for causing the inside of the first treatment agent-storage container 80 to be under negative pressure is as mentioned above. The first treatment agent-storage container 80 is provided with needles 87 and 88 at the respective positions on the bottom part 86, corresponding to the second introduction port 81 and the first introduction port 82 of the ceiling part 85. A side wall of the first treatment agent-storage container 80 is provided with a discharge port 89 for transporting a prepared discharge-printing treatment agent 120 to the outside. The discharge port 89 is sealed with a seal member 90. The second treatment agent-storage container 100 has a tubular shape such as a cylindrical shape or a rectangular-tube like shape, and the upper part thereof is opened. A bottom part thereof is provided with a discharge port 102 for discharging the second treatment agent 101. The discharge port 102 is linked to a discharge tube 103. A bottom part of the discharge tube 103 is sealed with a seal member 104. The first treatment agent-supply container 110 has a tubular shape such as a cylindrical shape or a rectangular-tube like shape. The bottom part of the first treatment agent-supply container 110 is provided with a discharge port 112 for discharging the first treatment agent 111. The discharge port 112 is linked to a discharge tube 113. The bottom part of the discharge tube 113 is sealed with a seal member 114, so that the inside of the first treatment agent-supply container 110 is shielded from outside air and is under an atmosphere of inactive gas. The inactive gas is the same as mentioned above.

A method for using the discharge-printing treatment agent storage container of the present embodiment is described below. First, as shown in FIG. 9B, the tips of discharge tubes 103 and 113 are placed in a first treatment agent-storage container 80 by opening a second check valve 84 and a first check valve 83 through inserting the discharge tubes 103 and 113 into a second introduction port 82 and a first introduction port 81, respectively. In this case, a needle 88 penetrates a seal member 104, and a needle 87 penetrates a seal member 114. Therefore, since the inside of the first treatment agent-storage container 80 is under negative pressure, a second treatment agent 101 is transferred to the first treatment agent-storage container 80 by atmosphere pressure, and a first treatment agent 111 is transferred to the same by pressure of the inactive gas.

Then, as shown in FIG. 9C, a transport needle 122 placed at the tip of a transport tube 121 is caused to penetrate a seal member 90, so that the tip of the transport needle 122 is inserted into the first treatment agent-storage container 80. Thereafter, a discharge-printing treatment agent 120 is transported to the outside.

It will be obvious to those having skill in the art that many changes may be made in the above-described details of the particular aspects described herein without departing from the spirit or scope of the invention as defined in the appended claims.

What is claimed is:

1. A discharge-printing agent storage container for storing a discharge-printing treatment agent, the discharge-printing agent storage container comprising:

a first treatment agent-storage container;

a second treatment agent-storage container, and a transport tube provided with an opening in a bottom part thereof, wherein the discharge printing treatment agent is prepared by mixing a liquid or solid first treatment agent and a liquid second treatment agent in use, the first treatment agent contains a reducing treatment agent which is deteriorated by oxygen, a part of the first treatment agent-storage container is provided with an introduction port for introducing the second treatment agent, the inside of the first treatment agent-storage container is shielded from outside air by sealing the introduction port with a first check valve, the first check valve is partially fixed on the area surrounding the introduction port of the first treatment agent-storage container, the first treatment agent-storage container has a double bottom structure, an inner bottom in the double bottom structure is movable toward outside, a part of an outer bottom in the double bottom structure is provided with an opening, the second treatment agent-storage container is a cylinder capable of inserting a piston therein, a side opposite to a side of inserting the piston of the cylinder is provided with a discharge port for discharging the second treatment agent, the discharge port is linked to a discharge tube, a tip of the discharge tube is capable of being placed in the first treatment agent-storage container by opening the first check valve through inserting the discharge tube to the introduction port, the second treatment agent in the cylinder is capable of being transferred by applying pressure with the piston under a state where the tip of the discharge tube is placed in the first treatment agent-storage container atmospheric air is capable of being exhausted from the opening of the outer bottom according to a movement of the inner bottom by the transfer, the discharge-printing treatment agent prepared by mixing the first treatment agent and the second treatment agent is shielded from outside air in the first treatment agent-storage container through sealing the introduction port with the first check valve by pulling the tip of the discharge tube out of the introduction port of the first treatment agent-storage container, a transport needle is placed at the tip of a transport tube, the tip of the transport needle is placed in the first treatment agent-storage container through opening the first check valve by inserting the transport needle into the introduction port of the first treatment agent-storage container, and the discharge-printing treatment agent is transported to the outside using the transport tube in a state where the tip of the transport tube is placed in the discharge-printing agent storage container.

2. The discharge-printing treatment agent storage container according to claim 1, wherein a part of the first treatment agent-storage container is composed of a deformable member as substitute for the inner bottom that is movable in the double bottom structure, the second treatment agent in the cylinder is capable of being transferred by applying pressure with the piston under a state where the tip of the discharge tube is placed in the first treatment agent-storage container, and atmospheric air is capable of being exhausted from the opening of the outer bottom according to a deformation of the part of the first treatment agent-storage container by the transfer.

3. A discharge printing treatment agent storage container for storing a discharge-printing treatment agent, the discharge-printing treatment agent storage container comprising:

a first treatment agent-supply container, a first treatment agent-storage container, and a second treatment agent-storage container, wherein the discharge printing treatment agent is prepared by mixing a liquid or solid first treatment agent and a liquid second treatment agent in use, the first treatment agent contains a reducing treatment agent which is deteriorated by oxygen, the first treatment agent-supply container is provided with a discharge port for discharging the first treatment agent, the discharge port is linked to a discharge tube, the first treatment agent-storage container is provided with a first introduction port for introducing the first treatment agent, a second introduction port for introducing the second treatment agent, a discharge port for transporting the prepared discharge-printing treatment agent to outside, and a seal member for sealing the discharge port, the inside of the first treatment agent-storage container is shielded from outside air by sealing the first introduction port and the second introduction port with a first check valve and a second check valve, respectively, the first check valve is partially fixed on the area surrounding the first introduction port of the first treatment agent-storage container, the second check valve is partially fixed on the area surrounding the second introduction port of the first treatment agent-storage container, a tip of the discharge tube is capable of being placed in the first treatment agent-storage container by opening the first check valve through inserting the discharge tube on the first treatment agent-supply container to the first introduction port, the first treatment agent is capable of being transferred from the first treatment agent-supply container to the first treatment agent-storage container by applying pressure under a state where the tip of the discharge tube is placed in the first treatment agent-storage container, the second treatment agent-storage container is provided with a discharge port for discharging the second treatment agent, the discharge port is linked to a discharge tube, a tip of the discharge tube is capable of being placed in the first treatment agent-storage container by opening the second check valve through inserting the discharge tube of the second treatment agent-storage container to the second introduction port, and the second treatment agent is capable of being transferred from the second treatment agent-storage container to the first treatment agent-storage container by pressure under a state where the tip of the discharge tube is placed in the first treatment agent-storage container, a transport needle is placed at the tip of a transport tube, the tip of the transport needle is placed in the first treatment agent-storage container by penetrating the seal member for sealing the discharge port of the first treatment agent-storage container with the transport needle, and the discharge-printing treatment agent is transported to the outside using the transport tube in a state where the tip of the transport needle is placed in the first treatment agent-storage container.

* * * * *